US007828614B2

(12) United States Patent
Cribbs

(10) Patent No.: US 7,828,614 B2
(45) Date of Patent: Nov. 9, 2010

(54) PIGGYBACK AUXILIARY MOTOR BRACKET

(76) Inventor: William L Cribbs, 102 Lloyd Tallent Rd., Franklin, NC (US) 28734

( * ) Notice: Subject to any disclaimer, the term of this patent is extended or adjusted under 35 U.S.C. 154(b) by 538 days.

(21) Appl. No.: 11/873,279

(22) Filed: Oct. 16, 2007

(65) Prior Publication Data

US 2009/0098783 A1 Apr. 16, 2009

(51) Int. Cl.
*B63H 20/08* (2006.01)
*B63H 20/02* (2006.01)

(52) U.S. Cl. ..... 440/53; 440/63; 248/640

(58) Field of Classification Search ..... 440/53, 440/55–60, 62, 63; 248/640–643
See application file for complete search history.

(56) References Cited

U.S. PATENT DOCUMENTS 1,389,712 A * 9/1921 Thompson et al. ..... 440/55
2,895,445 A 7/1959 Foraker
2,937,880 A * 5/1960 Hicks et al. ..... 280/47.131
2,972,977 A * 2/1961 Hausmann ..... 440/65
3,111,929 A * 11/1963 Fisher ..... 416/120
3,139,853 A * 7/1964 McCarthy et al. ..... 440/66
3,274,849 A 9/1966 Hanson
3,473,764 A * 10/1969 Hopper ..... 248/641
3,505,971 A * 4/1970 Dalke ..... 440/49
3,567,164 A * 3/1971 Hakala ..... 248/641
3,596,625 A * 8/1971 Guenther ..... 440/6
3,763,819 A * 10/1973 Mays ..... 116/17
3,881,443 A 5/1975 Hamp
4,304,556 A * 12/1981 Wilson ..... 440/63
4,498,872 A * 2/1985 Shonley et al. ..... 440/63
5,002,509 A 3/1991 Uroszek
5,320,324 A * 6/1994 Norton ..... 248/640

FOREIGN PATENT DOCUMENTS

WO WO2006/128486 12/2006

* cited by examiner

*Primary Examiner*—Ajay Vasudeva
(74) *Attorney, Agent, or Firm*—Michael I. Kroll

(57) ABSTRACT

An outboard motor auxiliary mounting bracket for attaching an auxiliary motor to an existing outboard motor using the bracket of the instant invention. The bracket comprises an auxiliary motor mounting plate with divergently extending arms to receive the body of the outboard motor and fixed thereto. A third arm extends from the mounting plate downwardly and is also fastened to the outboard motor.

4 Claims, 10 Drawing Sheets

PIGGYBACK AUXILIARY MOTOR BRACKET

BACKGROUND OF THE INVENTION

1. Field of the Invention

The present invention relates generally to water craft and, more specifically, to water craft having an outboard motor with an auxiliary motor attached thereto by means of the bracket of the present invention. The bracket has an auxiliary motor mounting plate with divergently extending arms to receive the body of the outboard motor and fixed thereto. A third arm extends from the mounting plate extending downwardly and is also fastened to the outboard motor. Additionally the reason the auxiliary motor can be mounted rigidly is that the main motor has a five inch longer shaft, allowing the auxiliary motor to be mounted so when in a plane the auxiliary motor is out of the water, and when dropped down from a plane, it is deep enough to prevent cavitation. Also the depth is set by the trim on the main motor.

2. Description of the Prior Art

There are other mounting devices designed for watercraft. Typical of these is U.S. Pat. No. 2,895,445 issued to Foraker on Jul. 21, 1959.

Another patent was issued to Fisher on Nov. 26, 1963 as U.S. Pat. No. 3,111,929. Yet another U.S. Pat. No. 3,139,853 was issued to McCarthy et al. on Jul. 7, 1964 and still yet another was issued on Sep. 27, 1966 to Hanson as U.S. Pat. No. 3,274,849.

Another patent was issued to Hopper on Oct. 21, 1969 as U.S. Pat. No. 3,473,764. Yet another U.S. Pat. No. 3,505,971 was issued to Dalke on Apr. 14, 1970. Another was issued to Hakala on Mar. 2, 1971 as U.S. Pat. No. 3,567,164 and still yet another was issued on May 6, 1975 to Hamp as U.S. Pat. No. 3,881,443.

Another patent was issued to Wilson on Dec. 8, 1981 as U.S. Pat. No. 4,304,556. Yet another U.S. Pat. No. 4,498,872 was issued to Shonley et al. on Feb. 12, 1985. Another was issued to Uroszek on Mar. 26, 1991 as U.S. Pat. No. 5,002,509 and still yet another was published on Dec. 7, 2006 to Pruin as International Patent Application No. WO 2006/128486.

U.S. Pat. No. 2,895,445

Inventor: David K. Foraker

Issued: Jul. 21, 1959

In a boat having a transom, and twin outboard motors mounted on said transom at opposite sides of the boat and swingable to steer the boat, means for swinging said motors in unison comprising a tiller lever extending forwardly from said transom, means terminally mounting said lever on said transom for swinging in opposite directions, cable and pulley means attached to opposite sides of said lever and to opposite sides of the boat for swinging said lever, and operating connections extending from opposite sides of said lever to said motors, respectively, for swinging of said motors in response to swinging of said lever in opposite directions.

U.S. Pat. No. 3,111,929

Inventor: Forrest S. Fisher

Issued: Nov. 26, 1963

A transom attachment for engagement with a pivotally mounted primary outboard engine to provide support for holding an auxiliary engine in operative and steering arrangement on and with respect to said primary engine comprising opposed bracket elements engaging the frame of said primary engine and extending rearwardly and substantially horizontally therefrom, support faces on said bracket elements extending inwardly toward the opposite bracket element and disposed at an angle with respect to the horizontal direction of extension for said bracket elements, and a transom board extending between said opposed bracket elements and in engagement with the said angularly disposed support faces to provide the required support for said auxiliary engine in position rearwardly from and in piggy-back arrangement with respect to said primary engine whereby said auxiliary engine may be used to operate and steer said boat.

U.S. Pat. No. 3,139,853

Inventor: William P. McCarthy et al

Issued: Jul. 7, 1964

In combination with an outboard motor having a propeller shaft, a housing for said shaft and a normally horizontally disposed anti-cavitation plate carried by said housing, a trolling motor mounted upon said plate and lying in substantially the same plane as said plate.

U.S. Pat. No. 3,274,849

Inventor: Chris A. Hanson

Issued: Sep. 27, 1966

An extension handle for a marine outboard motor having a horizontal carrying handle at the front surface thereof, comprising:

a vertical member having a releasable clamping element at its lower end adapted to be secured to the motor carrying handle;

and a forwardly directed member fixed to the upper end of said vertical member, said forwardly directed member having a grip mounted on its forward end.

U.S. Pat. No. 3,473,764

Inventor: Elvin E. Hopper

Issued: Oct. 21, 1969

An outboard trolling motor mount for use in mounting an outboard trolling motor on the outboard drive unit of a boat equipped with an inboard/outboard type power unit, comprising a generally L-shaped bracket including a generally horizontal arm connected with a generally vertical arm, said horizontal arm having a generally flat top formed with a recess extending from the front edge thereof rearwardly toward its connection with said vertical arm for receiving a portion of an outboard drive unit, means forming inwardly open channels along each side edge of said horizontal arm, adjustable means carried by said horizontal arm and projecting into said channels for clampingly securing the mount to an outboard drive unit of an inboard/outboard power unit, means forming a mounting block at the upper free end of said vertical arm for clampingly receiving and supporting an outboard trolling motor, and a member adjustably connected at one end to said vertical arm and extending forwardly therefrom and terminating in hook means for detachable attachment to an outboard drive unit of an inboard/outboard power unit.

U.S. Pat. No. 3,505,971

Inventor: Herbert Dalke

Issued: Apr. 14, 1970

An outboard motor mount attachment for an inboard-outboard motor, comprising (a) a framework having front, rear and bottom sides,
(b) bracket means projecting forwardly from the front side of the framework for releasable attachment to an inboard-outboard motor,
(c) anchor means projecting downward from the bottom side of the framework for releasable engagement with the inboard-outboard motor,
(d) an outboard motor mounting member on the rear side of the framework, and
(e) laterally spaced stabilizer means projecting downward from the bottom side of the framework forward of the anchor means for releasable engagement with opposite sides of the inboard-outboard motor.

U.S. Pat. No. 3,567,164

Inventor: Ruben V. Hakala

Issued: Mar. 2, 1971

An outboard motor support means which is particularly adapted for attachment to a primary outboard motor mounted on a boat transom and which has a fixed support section with a movable support section pivotally mounted thereon having means for supporting an outboard motor, and with the movable support section having a lever means extending forwardly toward the boat for pivotally moving the movable support section, thereby effecting vertical movement of the outboard motor into or out of the water. A latch means is also provided for holding the movable support section and the outboard motor in a selected vertical position. Spring means are also preferably provided which connect the opposite sides of the fixed support section of the outboard motor support means to the opposite end portions of the boat transom to automatically center the outboard motor mounted thereon when the steering mechanism is unattended and maintain the boat traveling along a straight course.

U.S. Pat. No. 3,881,443

Inventor: John K. Hamp

Issued: May 6, 1975

Boat propulsion apparatus including a main outboard motor mounted on a transom for driving and steering the boat at cruising speeds and including an electric outboard motor for driving the boat at trolling speeds which motor is connected with the main outboard motor for steering in unison with the latter, the trolling outboard being mounted so that its submersible motor unit is vertically reciprocable between an idle "up" position and a submerged "down" position and includes a power driven device with limit switches to place it selectively in one position or the other, the trolling outboard being remotely controllable from a control head box as to the speed and direction of its submersible drive motor and as to the "up/down" position of its motor unit, and both outboards being interlocked by way of the limit switches so that the main outboard can not be run with the trolling motor down in drive position and so that the trolling motor can not be run with its submersible motor unit in "up" position.

U.S. Pat. No. 4,304,556

Inventor: Larry E. Wilson

Issued: Dec. 8, 1981

A bracket is provided for attaching an outdrive auxiliary motor to a motor boat. The auxiliary motor functions as a source of emergency power and the bracket enables mounting of the auxiliary motor in place without impairing the maneuverability of the boat either under its normal source of power or its auxiliary source.

U.S. Pat. No. 4,498,872

Inventor: Ivan T. Shonley et al.

Issued: Feb. 12, 1985

A device for connecting the upper end of an auxiliary motor mount to the stern of an inboard/outboard boat when used in conjunction with a mount with pivotal lower anchoring device on the stern drive. The device allows full movement of the main drive both horizontally and vertically without impairing its movement or allowing the auxiliary motor to come in contact with or damage the stern of the boat in any position attainable by the stern drive, while allowing the operator to steer the auxiliary motor from either the pilot's compartment or with the individual controls of the auxiliary motor.

U.S. Pat. No. 5,002,509

Inventor: Larry Uroszek

Issued: Mar. 26, 1991

An outboard trolling motor mount for use in mounting an outboard trolling motor on the outboard drive unit of a boat equipped with an inboard/outboard type power unit is disclosed. The motor mount includes a mounting block for supporting an outboard trolling motor and a support structure attachable to the outboard drive unit through the drive unit's top cover for supporting the mounting block to one side of the drive unit at a location behind the boat's transom.

U.S. Patent Number WO 2006/128486

Inventor: Berend Pruin

Published: Dec. 7, 2006

The invention relates to an auxiliary drive device used as an auxiliary device for ships. Said device comprises at least one propulsion unit (11, 12) which acts both as a thruster and a driving mechanism and can be displaced in different positions inside the outer cross-sectional contour of the ship.

While these brackets may be suitable for the purposes for which they were designed, they would not be as suitable for the purposes of the present invention, as hereinafter described.

SUMMARY OF THE PRESENT INVENTION

A primary object of the present invention is to provide a bracket for mounting an auxiliary motor to an existing outboard motor.

Another object of the present invention is to provide a bracket having a mounting plate for attachment of the auxiliary motor.

Yet another object of the present invention is to provide a bracket having a mounting plate with divergently extending arms for receiving said outboard motor.

Still yet another object of the present invention is to provide a bracket wherein said arms have a plurality of apertures for securing the bracket to the outboard using appropriate fasteners.

Another object of the present invention is to provide a bracket having a downwardly depending arm with a plurality of apertures for securing the bracket to the outboard using appropriate fasteners.

Additional objects of the present invention will appear as the description proceeds.

The present invention overcomes the shortcomings of the prior art by providing means for attaching an auxiliary motor to an existing outboard motor using the bracket of the instant invention. The bracket comprises an auxiliary motor mounting plate with divergently extending arms to receive the body of the outboard motor and fixed thereto. A third arm extends from the mounting plate downwardly and is also fastened to the outboard motor.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
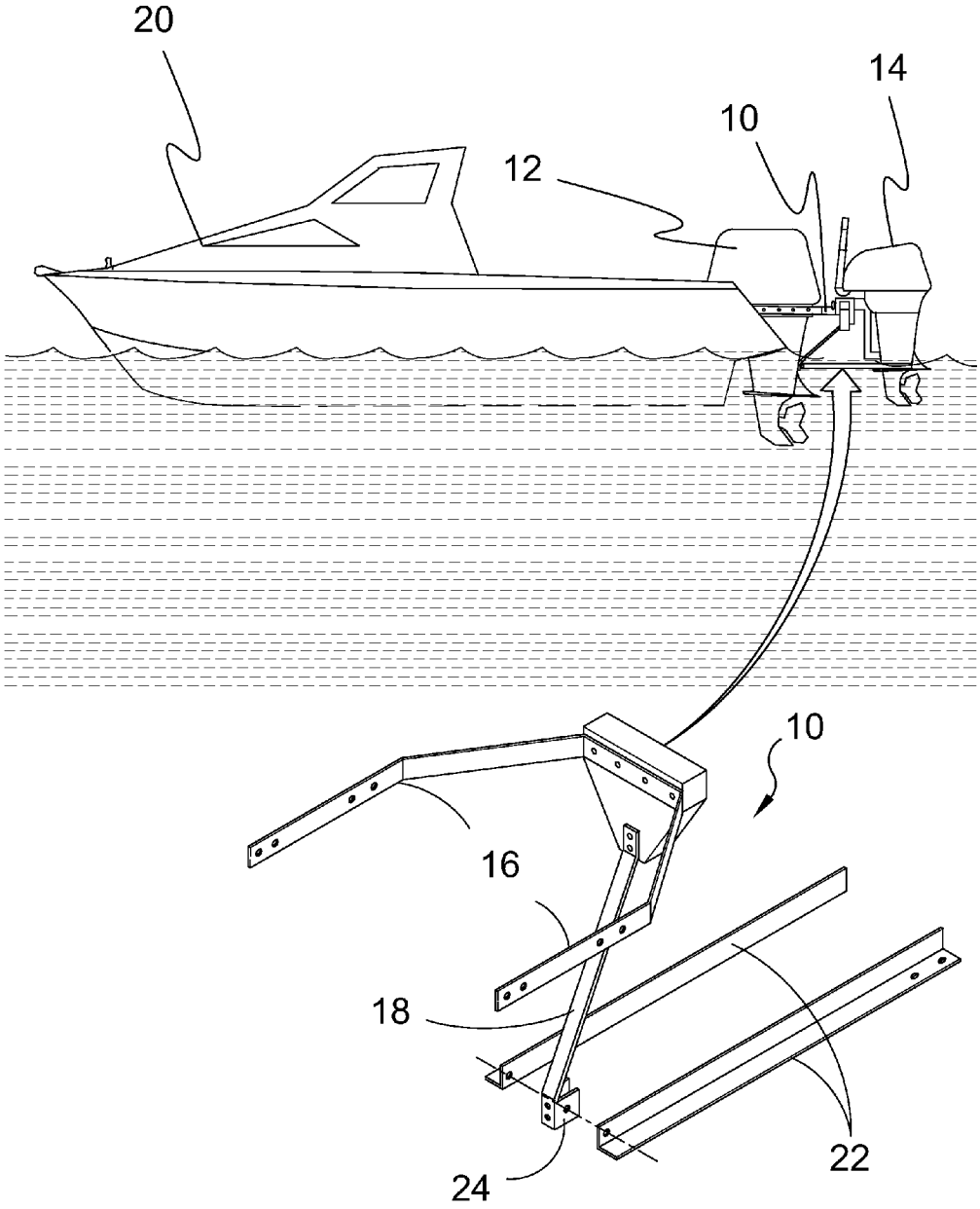
FIG. 1 is an illustrative view of the auxiliary motor mount in use.

Turning now descriptively to the drawings, in which similar reference characters denote similar elements throughout the several views, the figures illustrate the Outboard Motor Auxiliary Mounting Bracket of the present invention. With regard to the reference numerals used, the following numbering is used throughout the various drawing figures.

10 Outboard Motor Auxiliary Mounting Bracket of the present invention
12 main outboard motor
14 auxiliary motor
16 main mounting arm
17 mounting bracket
18 angled arm support
20 boat
22 angle bracket stabilizer arm
24 channel bracket
26 mounting recess
28 bolt
30 screw
32 cavitation plate
34 fuel line
36 main fuel tank

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the auxiliary motor mount 10 in use. The present invention is an auxiliary motor-mount bracket 10 for the attachment to a boat's main outboard motor 12. The auxiliary motor 10 is rigidly mounted to the main motor 12 and allows operation by the boats 20 steering wheel and auto pilot, rendering its operation hands free. The auxiliary motor 14 operates off the main fuel tank through a fuel line switch. The auxiliary (piggy back) motor 14 does not affect the performance of the boat and is used as a backup motor and a trolling motor. The reason the auxiliary motor 14 can be mounted rigidly is that the main motor 12 has a five inch longer shaft, allowing the auxiliary motor 14 to be mounted so when in a plane the auxiliary motor is out of the water, and when dropped down from a plane, it is deep enough to prevent cavitation. Shown is the main motor mounting bracket 10 for an auxiliary motor comprising a pair of main mounting arms 16 for fastening the bracket 10 to the main motor 12 and an angled arm support 18 for attachment to the motor shaft. Also shown are a pair of angle-bracket stabilizer arms 22 which are fastened to the angled arm support 18 channel-bracket 24 and the auxiliary motor cavitation plate. Also the depth is set by the trim on the main motor 12.

Figure 2:
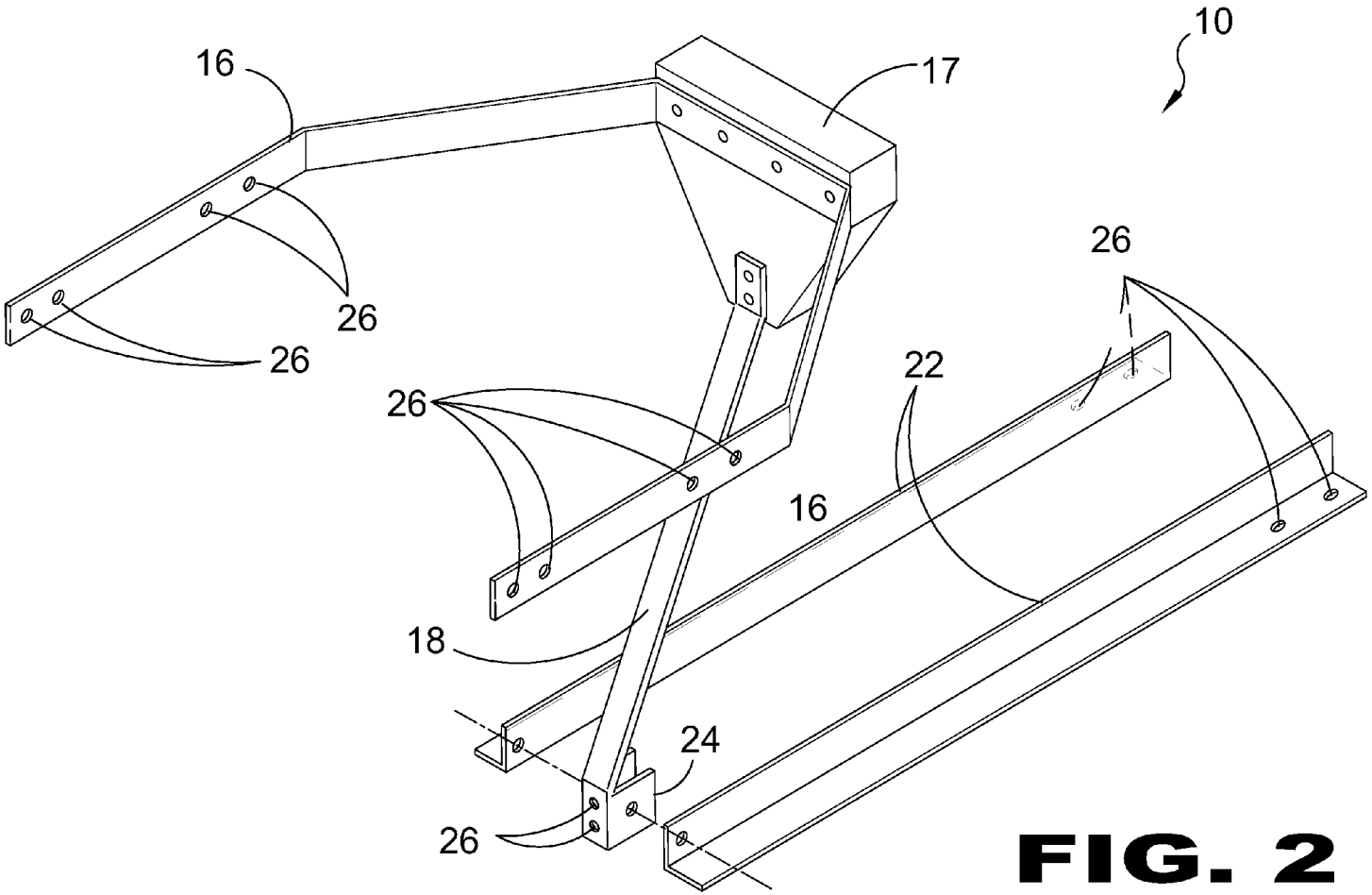
FIG. 2 is a perspective view of the auxiliary motor mounting bracket of the present invention.

FIG. 2 is a perspective view of the auxiliary motor mounting bracket 10. Illustrated is the main motor mounting bracket 10 for an auxiliary motor comprising a mounting plate 17 having a pair of main mounting arms 16 projecting divergently therefrom for fastening the bracket 10 to the main motor 12 and an angled arm support 18 for attachment to the motor shaft. Also shown are a pair of angle-bracket stabilizer arms 22 which are fastened to the angled arm support 18 channel-bracket 24 and the auxiliary motor cavitation plate. A plurality of mounting recesses 26 are disposed on the various arms and brackets.

Figure 3:
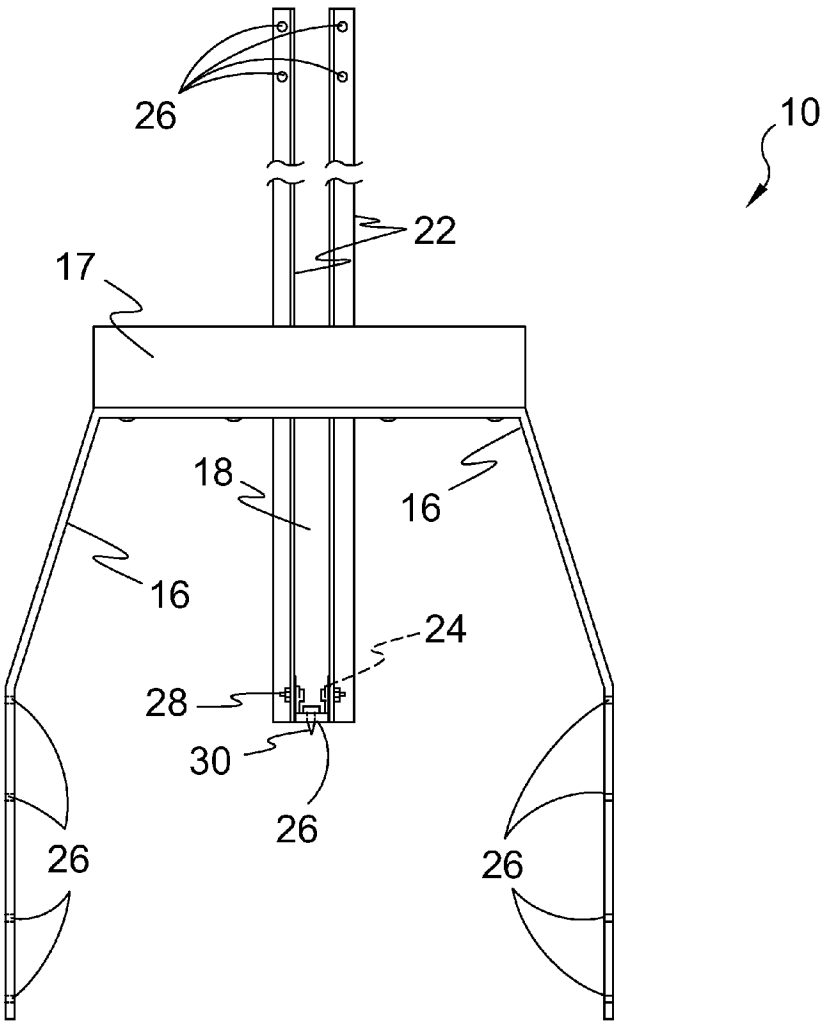
FIG. 3 is a top view of the auxiliary motor mount of the present invention.

FIG. 3 is a top view of the auxiliary motor mount 10. Shown are the main mounting arms 16 and the angled arm support 18 extending from the main mounting plate 17 and the angle bracket stabilizer arms 22 secured to the channel bracket 24 of the angled arm support with bolts 28 passing through their respective mounting recesses 26. A screw 30 is provided for the mounting recess 26 to the shaft housing. The auxiliary motor rigidly mounted to the main motor allows operation by the boat's steering wheel and auto pilot, rendering it operation hands free. The auxiliary motor operates off the main fuel tank by incorporating a fuel line selector switch for either motor.

Figure 4:
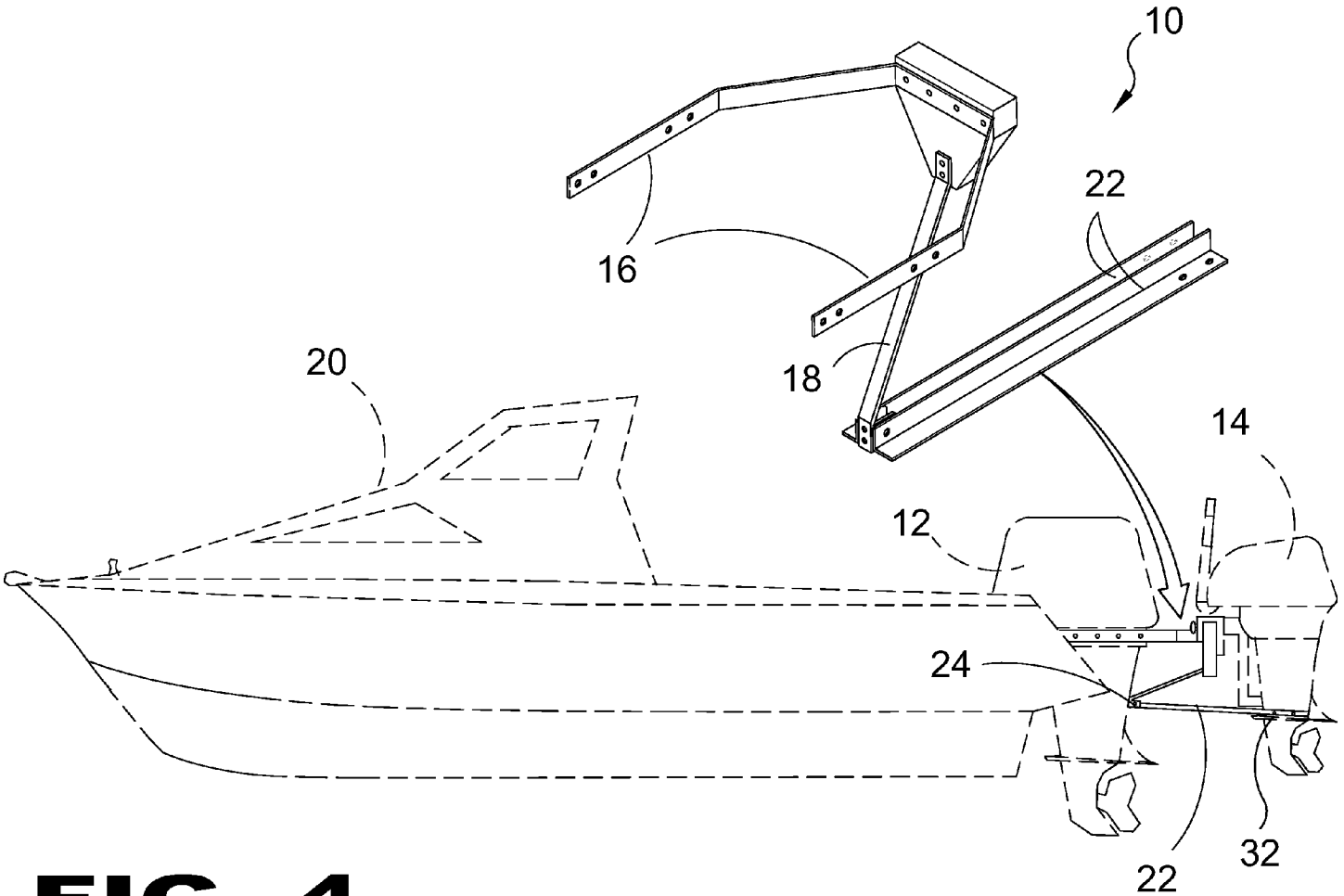
FIG. 4 is a side view of the auxiliary motor mount of the present invention in use.

FIG. 4 is a side view of the auxiliary motor mount of the present invention 10 in use. Shown is the auxiliary motor-mount bracket 10 comprising a pair of arms 16 for fastening the bracket 10 to the main motor 12 housing of a boat 20 along with an angled arm support 18 having a channel bracket 24 serving as fastener for auxiliary motor stabilizer arms 22 attached to the cavitation plate 32 of the auxiliary motor 14.

Figure 5:
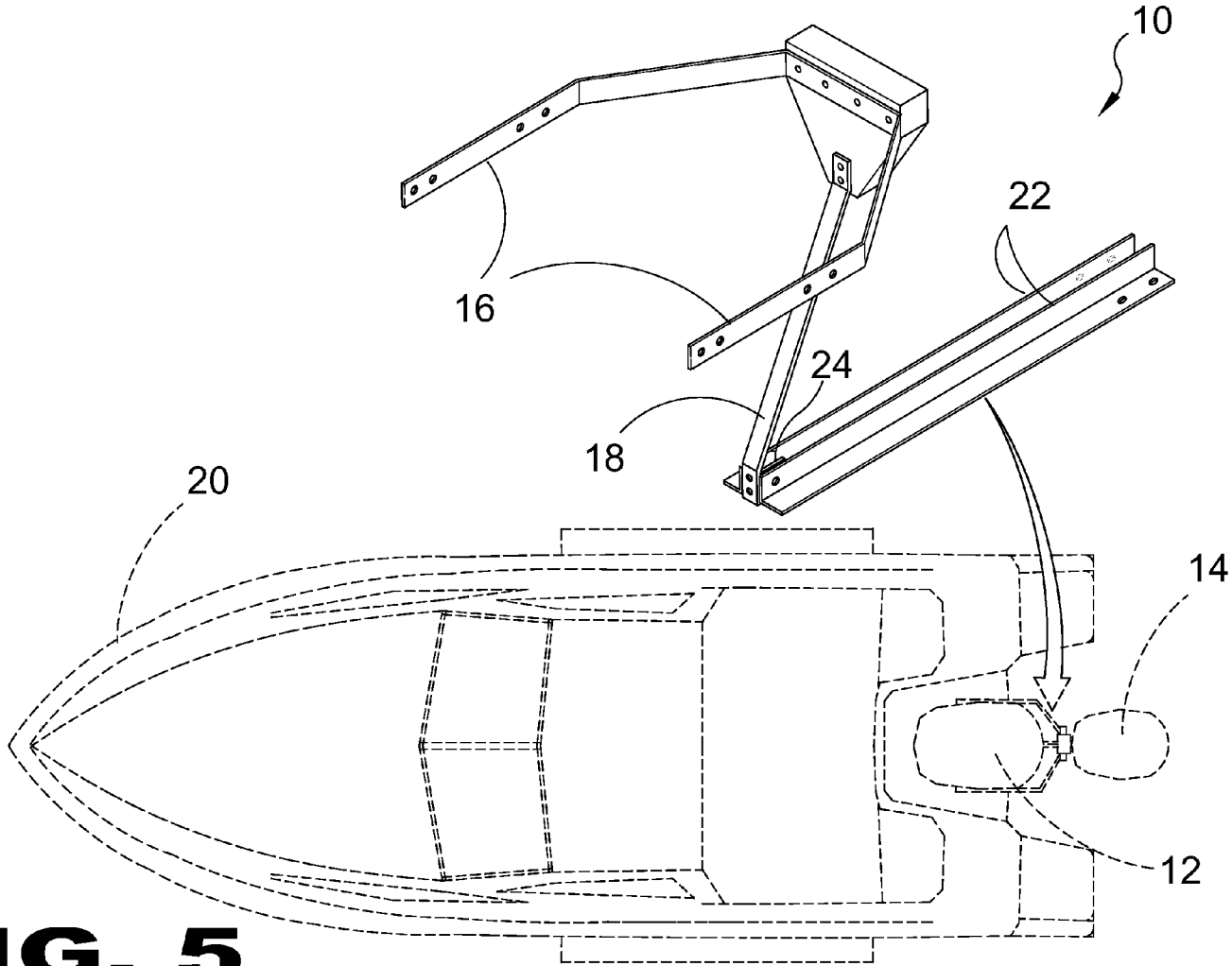
FIG. 5 is a top view of the auxiliary motor mount in use.

FIG. 5 is a top view of the auxiliary motor mount 10 in use. Shown is the auxiliary motor-mount bracket 10 comprising a pair of arms 16 for fastening the bracket 10 to the main motor 12 housing of a boat 20 along with an angled arm support 18 having a channel bracket 24 serving as fastener for auxiliary motor stabilizer arms 22 attached to the cavitation plate of the auxiliary motor 14.

Figure 6:
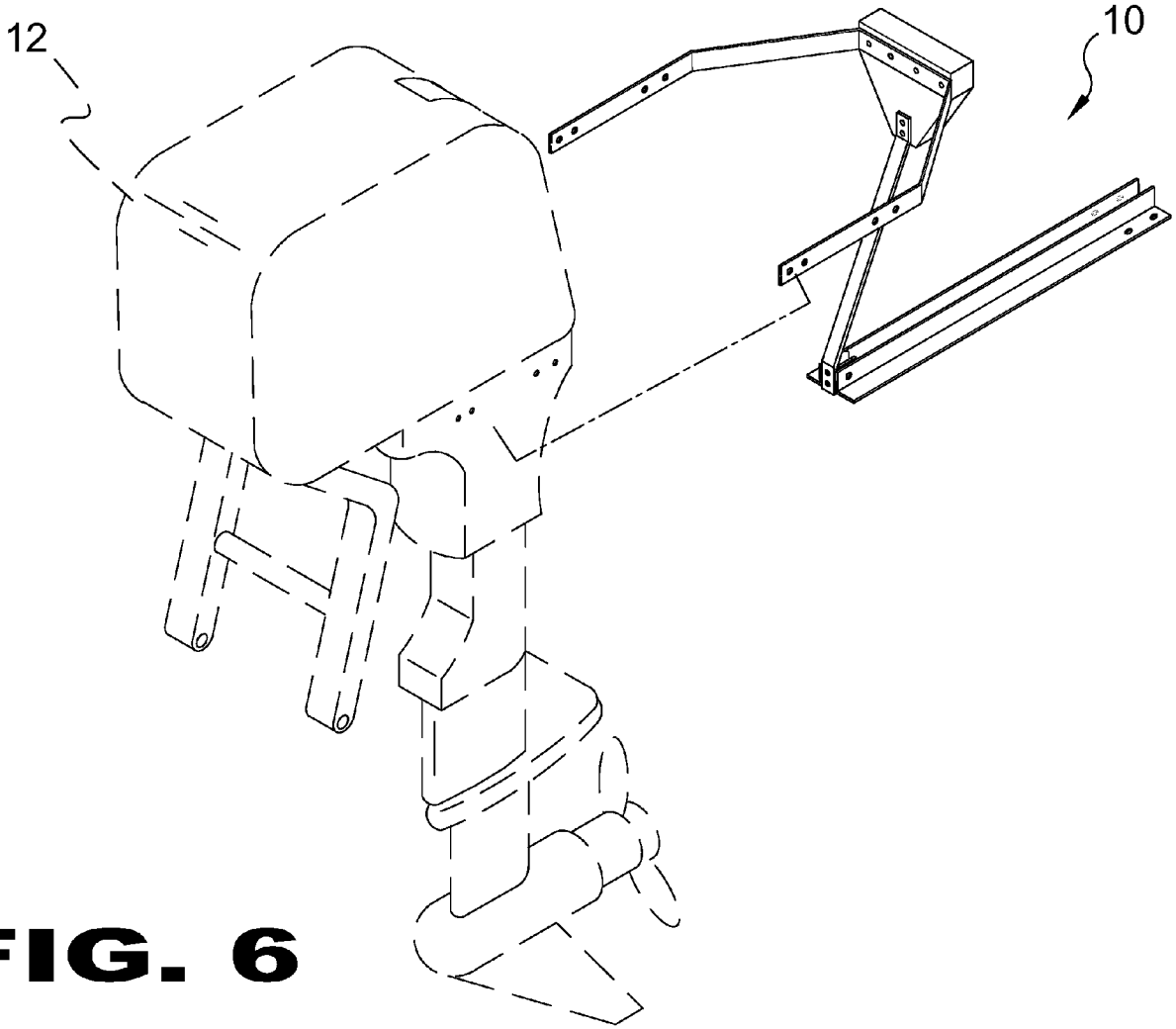
FIG. 6 is a perspective view of the present invention ready to be mounted to a boat's main motor.

FIG. 6 is a perspective view of the present invention 10 ready to be mounted to a boat's main motor 12. The present invention provides an auxiliary motor bracket 10 mountable to a main motor 12 whereby an auxiliary motor can be rigidly mounted thereto and function in similar fashion has the main motor 12 using the main motor steering system and fuel line by incorporating a fuel line selector switch for either motor. In addition to serving as a backup motor the auxiliary can serve as a trolling motor.

Figure 7:
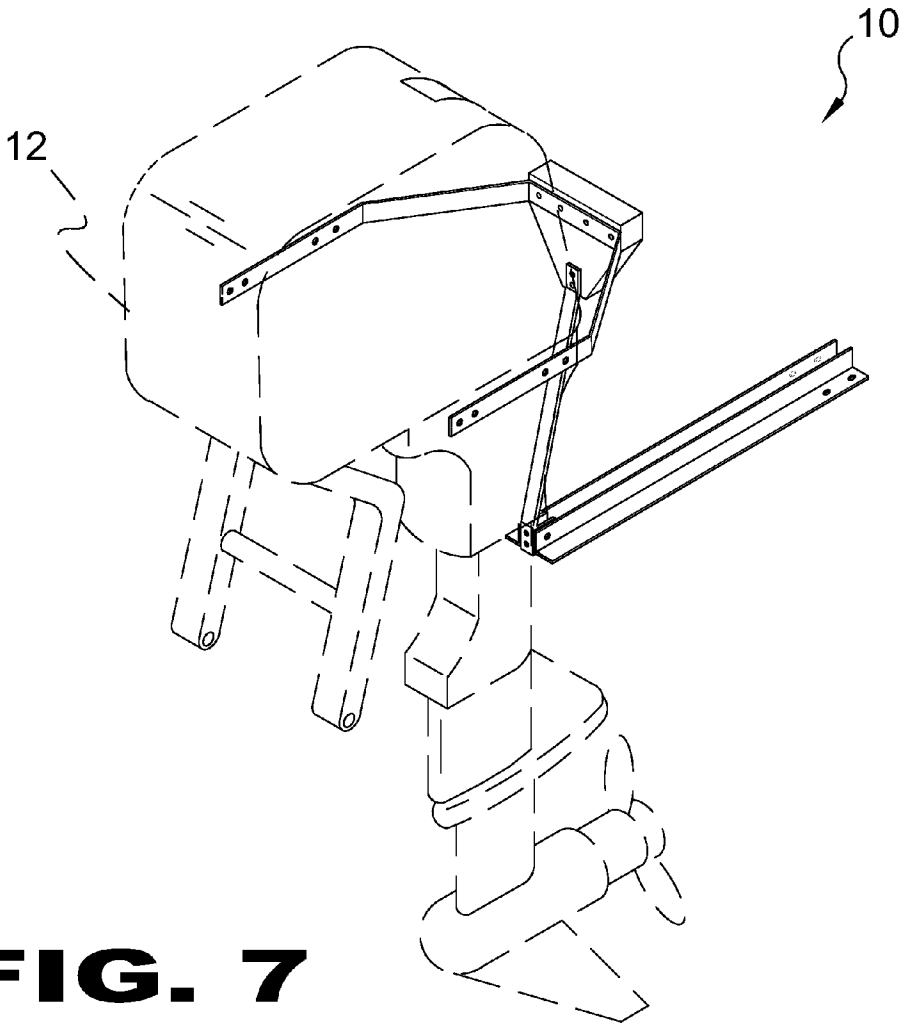
FIG. 7 is a perspective view of the auxiliary motor mount attached to a boat's main motor.

FIG. 7 is a perspective view of the auxiliary motor mount 10 attached to a boat's main motor 12. Shown is the auxiliary motor bracket 10 for the attachment to a boat's main outboard motor 12 of an auxiliary (piggy back) motor of smaller size. The auxiliary motor mounted to the main motor 12 allows operation by the boats steering wheel and auto pilot, rendering its operation hands free. The auxiliary motor operates off the main fuel tank. The auxiliary (piggy back) motor does not affect the performance of the boat and is used for a backup motor and a trolling motor.

Figure 8:
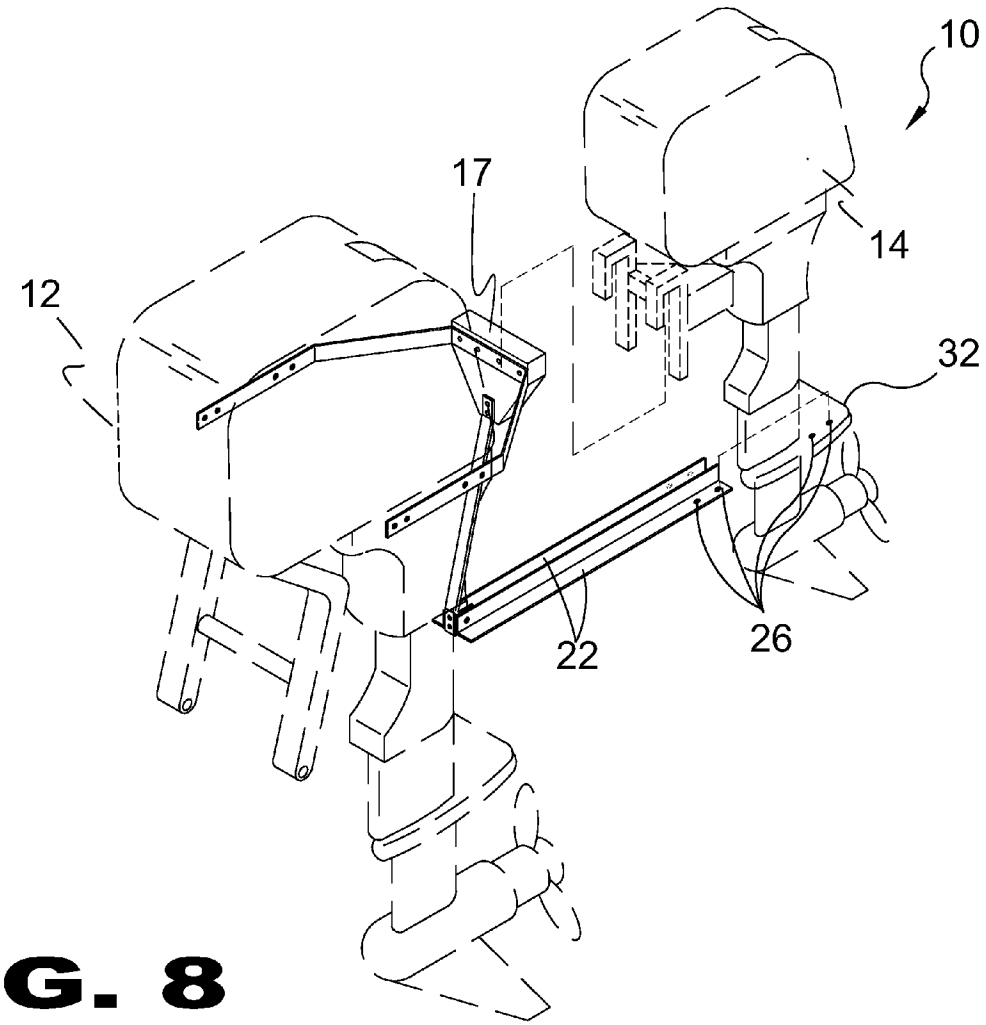
FIG. 8 is a perspective view of the present invention mounted to a boat's main motor and about to be mounted to an auxiliary motor.

FIG. 8 is a perspective view of the present invention 10 mounted to a boat's main motor 12 and about to have an auxiliary motor 14 mounted thereto. The auxiliary motor 14 is to be placed on the mounting bracket 17 and the distal ends of angle bracket stabilizer arms 22 gets secured to the cavitation plate 32 through the mating mounting recesses 26.

Figure 9:
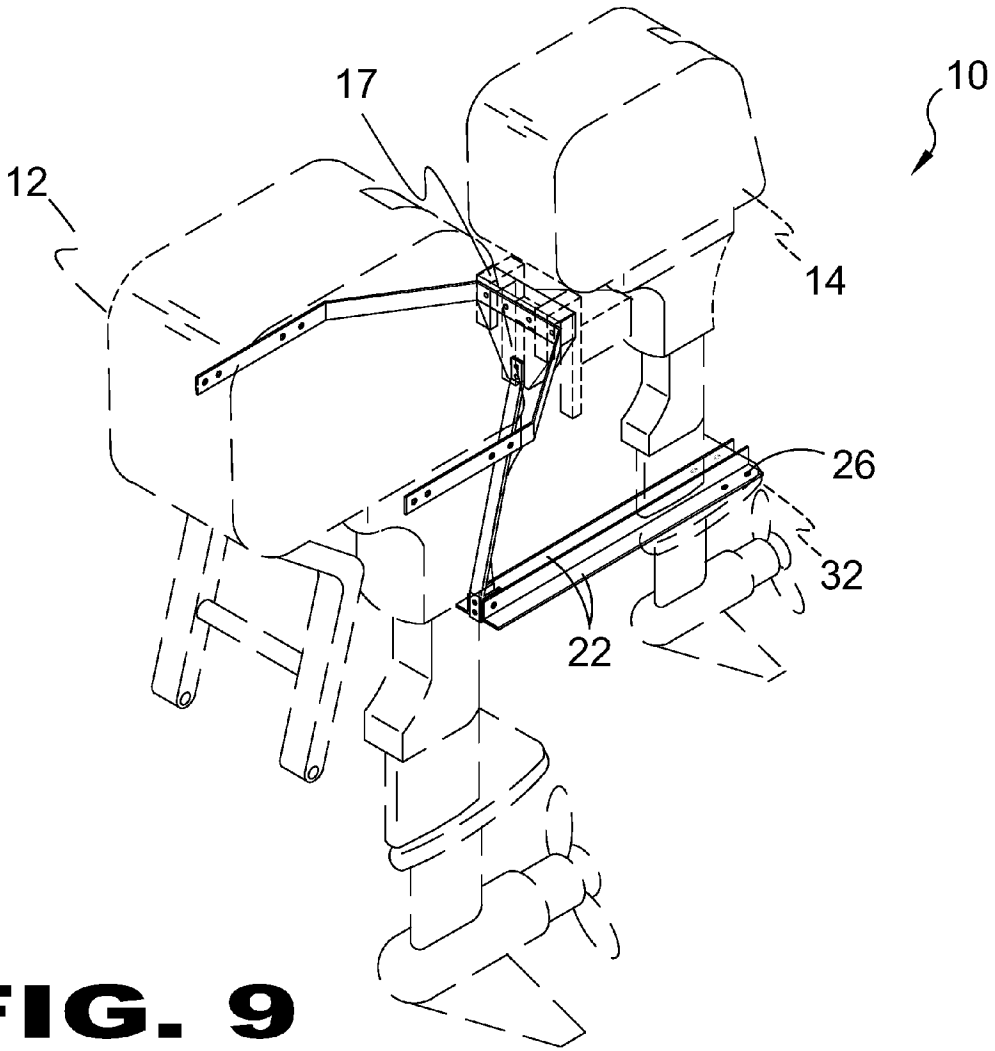
FIG. 9 is a perspective view of the present invention mounted to a boat's main motor and mounted to an auxiliary motor.

FIG. 9 is a perspective view of the present invention 10 mounted to a boat's main motor 12 and has the auxiliary motor 14 mounted thereto. The auxiliary motor 14 is seated on the mounting bracket 17 and the distal ends of angle bracket stabilizer arms 22 are secured to the cavitation plate 32 through the mating mounting recesses 26.

Figure 10:
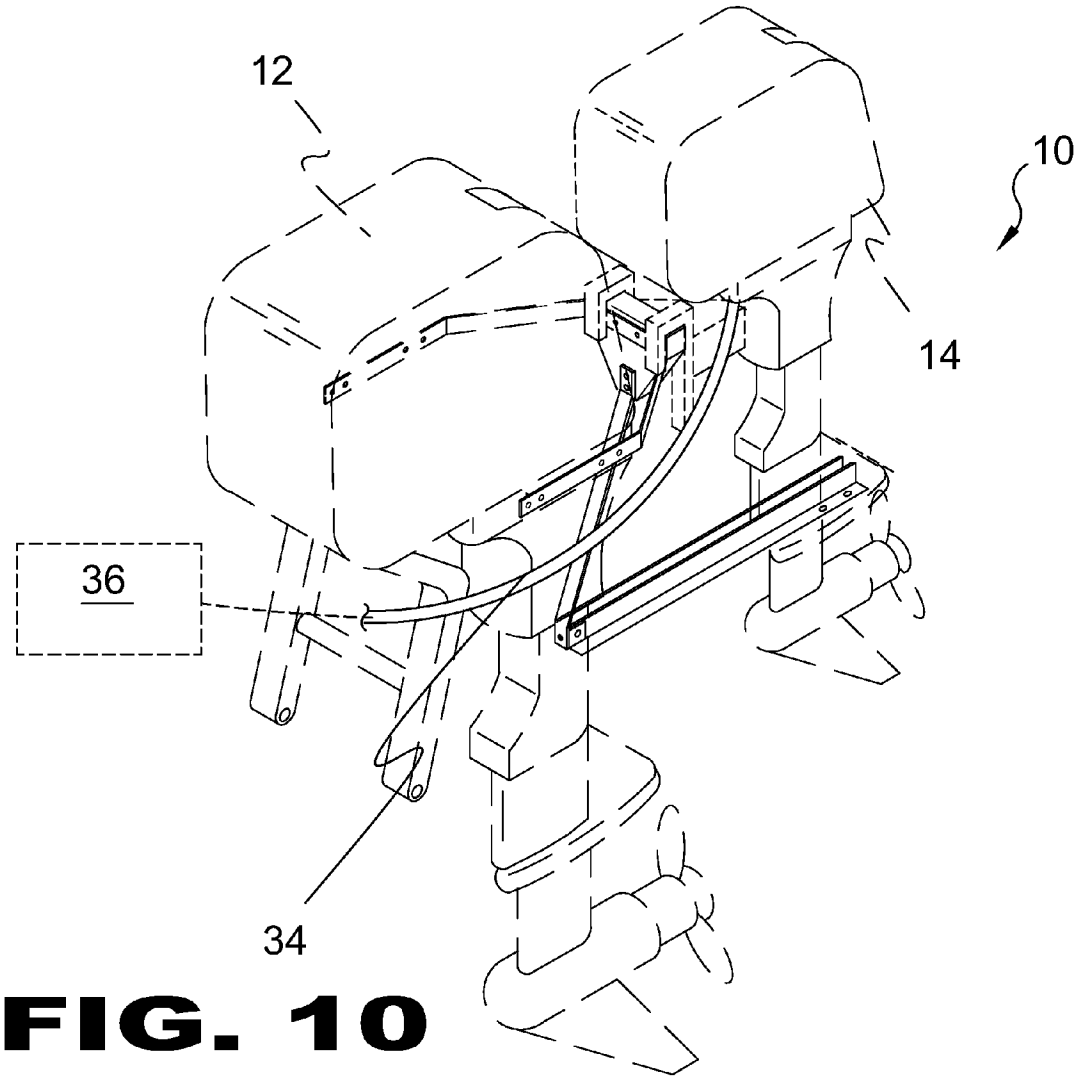
FIG. 10 is a perspective view of the present invention mounted to a boat's main motor and mounted to an auxiliary motor, using the main fuel line and tank.

FIG. 10 is a perspective view of the present invention 10 mounted to a boat's main motor 12 and mounted to an auxiliary motor 14, using the main fuel line 34 and tank 36. The auxiliary motor 14, being mounted to the main motor 12 allows operation by the boats steering wheel and auto pilot, rendering it hands free. The auxiliary motor 14 operates off the main fuel tank 36. The auxiliary (piggy back) motor 14 does not affect the performance of the boat and is used for a backup motor and a trolling motor.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An outboard motor auxiliary motor mount bracket for securing an auxiliary motor to the existing main outboard motor of a watercraft in piggy back fashion, said auxiliary mounting bracket comprising:

a) a mounting bracket;

b) a pair of symmetrical main mounting arms projecting divergently from opposing sides of said mounting bracket and turning to a parallel relationship with one another spaced apart at substantially the same distance as the width of the main motor housing;

c) mounting recesses disposed on the distal ends of said main mounting arms for receiving fastener elements to secure them to the housing of said main motor;

d) an angled arm support extending angularly downward towards the shaft of said main motor;

e) a channel bracket disposed on the distal end of said angled arm support having a plurality of mounting recesses disposed therein for receiving fastener elements for attachment to the shaft of said main motor;

f) a pair of spaced apart, substantially L-shaped angle bracket stabilizer arms having a proximal end secured said channel bracket;

g) an auxiliary outboard motor that is secured to said mounting bracket in the same manner as it would be installed on the transom of a boat once the auxiliary motor mount bracket is fully secured to said main motor; and h) a plurality of mounting recesses disposed at the distal ends of said angle bracket stabilizer arms for receiving fastener elements for attachment to the cavitation plate disposed on the shaft of said auxiliary motor.

2. The outboard motor auxiliary motor mount bracket recited in claim 1, wherein the shaft of said auxiliary motor terminates substantially prior to the terminus end of said main motor to prevent cavitation when said main motor is in operation.

3. The outboard motor auxiliary motor mount bracket recited in claim 1, wherein said auxiliary motor responds to the movement of said main motor due the piggy-back style mounting thereby requiring a single steering mechanism.

4. The outboard motor auxiliary motor mount bracket recited in claim 1, wherein the fuel delivery system of said auxiliary motor comprises an independent fuel line in communication with the main fuel tank.

* * * * *